US005263852A

United States Patent [19]

Beck

[11] Patent Number: 5,263,852

[45] Date of Patent: Nov. 23, 1993

[54] FIREPLACE BURNER PAN ASSEMBLY

[76] Inventor: Robert Beck, 10803 Fremont, Ontarior, Calif. 91761

[21] Appl. No.: 869,323

[22] Filed: Apr. 15, 1992

[51] Int. Cl.[5] ..... F23Q 2/32

[52] U.S. Cl. ..... 431/125; 431/326; 126/86; 126/512

[58] Field of Search ..... 126/512, 86, 88; 431/126, 326, 328, 125

[56] References Cited

U.S. PATENT DOCUMENTS

| | | | |
|---|---|---|---|
| 3,385,651 | 5/1968 | Rasmussen et al. | 431/328 |
| 3,583,845 | 6/1971 | Pulone | 431/125 |
| 4,512,329 | 4/1985 | Sweet | 126/121 |
| 4,828,485 | 5/1989 | Jankowski | 431/125 |
| 4,886,445 | 12/1989 | Richardson | 431/125 |
| 4,890,601 | 1/1990 | Potter | 431/328 X |
| 5,000,162 | 3/1991 | Shimek jet al. | 126/512 |
| 5,052,370 | 10/1991 | Karabin | 126/512 |
| 5,069,200 | 12/1991 | Thow et al. | 126/512 |

*Primary Examiner*—Larry Jones

*Attorney, Agent, or Firm*—Denton L. Anderson

[57] ABSTRACT

A fireplace gas burner unit is provided which allows for excellent aeration and distribution of the combustion gas without excessive gas flow noise. The burner includes a typical open-topped container box with triangular sides. A perforated burner pipe is disposed horizontally within the container box, with the perforations angled slightly towards the front of the box. A deflector plate is attached across the top of the burner pipe and is slanted forward and downwardly to form a narrow slit near the front of the container box. The narrow slit has a long central section and opposing periphery sections. The central section has a greater opening height than the periphery sections.

20 Claims, 1 Drawing Sheet

FIREPLACE BURNER PAN ASSEMBLY

BACKGROUND

This invention relates generally to gas-fired burner assemblies and, in particular, to gas-fired burner assemblies used in fireplaces.

For safety, ecology and ease of operation reasons, gasfired fireplace units are being increasingly used in new construction rather than traditional wood burning units. However, gas-fired fireplace units traditionally suffer from the problem that they do not generally have the same "look and feel" of a traditional wood-burning unit.

One attempt to overcome this problem was suggested by Pulone in U.S. Pat. No. 3,583,845. Pulone taught to place the burner pipe in an open-topped box having triangular sides that slope from the rear of the fireplace towards the front. A simulated log is positioned on a grate immediately above the box. The box is filled with sand. In operation, the gas percolates up through the sand and ignites at the surface of the sand. Such combustion gives the approximate appearance of a glowing bed of burning charcoal.

Unfortunately, Pulone and other prior art units are not wholly satisfactory. For example, the use of small grained noncombustible material in the burner pan, such as sand, frequently results in channeling of the gas as it percolates to the surface. Such channeling causes a marked non-uniformity in the ignition pattern across the surface of the sand. Also, the use of such small grain non-combustible materials inhibits the mixing of air with the gas, and sometimes results in the incomplete combustion of the gas.

In an attempt to get better air/gas mixing, large, irregularly-shaped granules such as crushed cinders have been tried. Although partially successful in this regard, the use of large, irregularly-shaped granules has not helped the gas distribution problem and has introduced the additional problem of excessive gas-flow noise.

Accordingly, there is a need for a gas-fired fireplace burner unit which more closely approximates the "look and feel" of a traditional wood burning unit.

Along these lines, there is a need for a gas-fired fireplace burner unit wherein gas is evenly distributed across the surface of the non-combustible material.

Finally, there is a need for a gas-fired fireplace unit wherein the gas is wholly aerated to assure complete combustion, without a resulting excessive amount of gas-flow noise.

SUMMARY OF THE INVENTION

The invention satisfies these needs.

The invention is a gas burner assembly comprising (a) an open-topped container pan, (b) a perforated gas burner pipe disposed horizontally within the container pan, and (c) a gas deflector plate disposed between the gas burner pipe and the forward edge of the container pan. The deflector plate is disposed with its forward-most edge proximate to the bottom wall of the container pan so as to form a narrow, horizontal slit. The horizontal slit has a long central section and a pair of periphery sections on each side of the central section. The height of the central section is more than 30% greater than the height at the periphery sections.

In a preferred embodiment of the invention, the sides of the container pan slope downwardly from the rear of the container pan towards the front of the container pan. In a most preferred embodiment, a short vertical baffle is disposed along the leading edge of the container pan bottom wall to form a small "gas dam" in front of the horizontal slit.

Preferably, the openings in the gas burner pipe are directed slightly towards the front of the container pan, such as about 10°-20° from the vertical.

In operation, it is preferred to use the burner pan with a combination of large grain sand and larger non-combustible particles, such as crushed cinders. The sand is placed at the bottom of the pan, below the burner pipe and the rest of the container box is covered with the large particle material.

The invention provides a clean-burning, quiet fire place burner unit which very closely approximates the "look and feel" of a wood burning unit.

DESCRIPTION OF THE DRAWINGS

These and other features, aspects, and advantages of the present invention will become better understood with reference to the following descriptions, appended claims, and accompanying drawings where:

DETAILED DESCRIPTION

Figure 1:
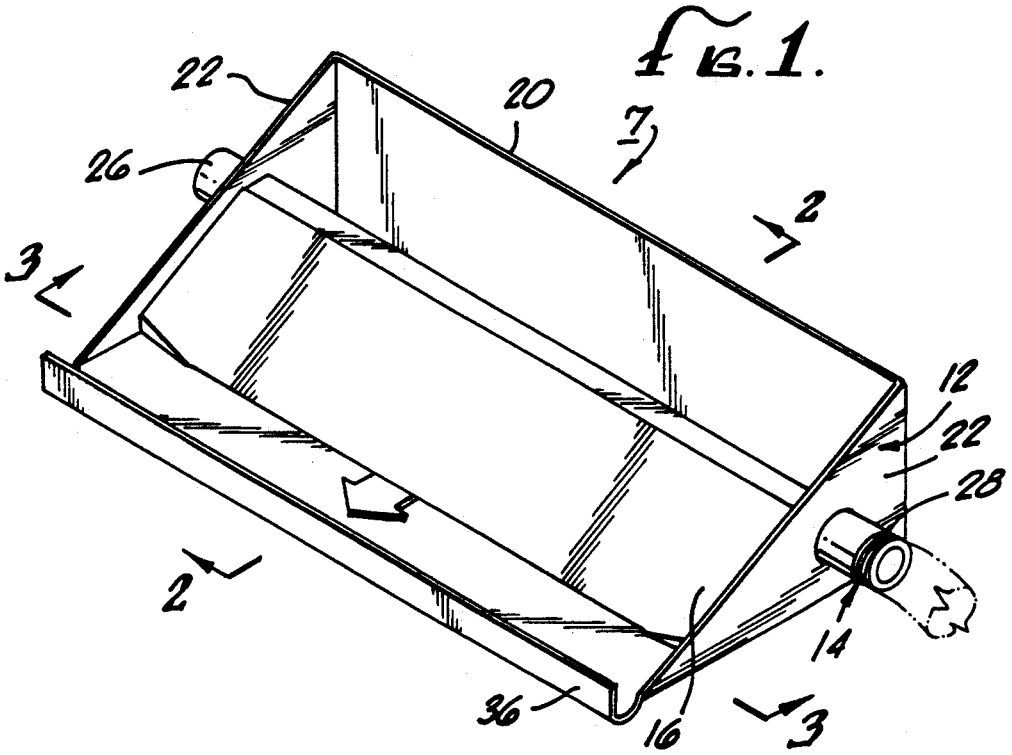
FIG. 1 is a perspective view of a burner pan having features of the invention.
Figure 2:
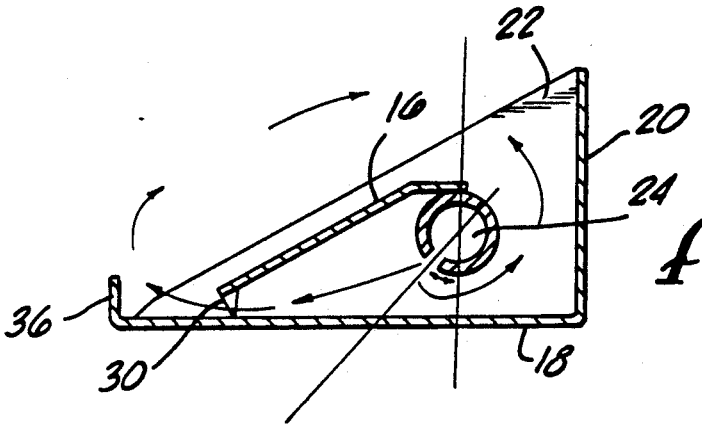
FIG. 2 is a cross-sectional view of the burner pan of FIG. 1 taken along 2—2.
Figure 3:
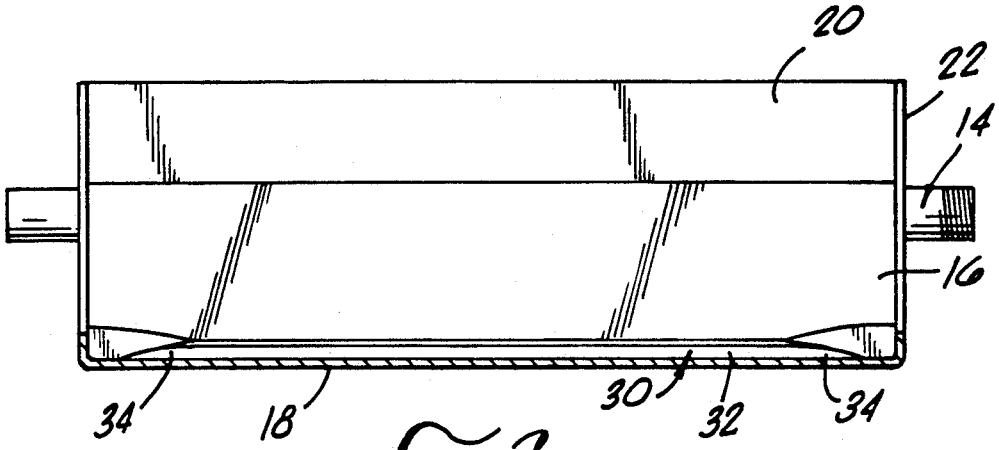
FIG. 3 is a cross-sectional view of the burner pan of FIG. 1 taken along 3—3.

The burner assembly of the invention 10 comprises (a) an open-topped container pan 12, (b) a perforated gas burner pipe 14, (c) means for connecting the burner pipe 14 to a source of combustion gas, and (d) a gas deflector plate 16.

The open-topped container pan 12 is made from a noncombustible material, such as sheet metal. In a typical embodiment, the container pan 12 is rectangular and has a horizontal bottom wall 18, a vertical back wall 20, and two opposing vertical side walls 22. Preferably, the two opposing side walls 22 are triangle-shaped or some other shape which slopes downwardly from the back wall 20 towards the bottom wall 18. In a typical embodiment, the opposing side walls 22 are parallel and spaced apart by a distance between about 10 inches and about 36 inches long.

The gas burner pipe 14 is a standard burner pipe commonly used in the art. It has at least one perforation 24 to allow gas to flow out of the burner pipe 14 and into the container pan 12. Preferably, the burner pipe 14 has at least 3 perforations 24, spaced between about 1 inches and about 3 inches apart. Such a plurality of perforations 24 allows for the even distribution of the outflow of burner gas along the length of the burner pipe 14. Preferably, the perforations 24 in the burner pipe 14 are uniform in diameter.

In a preferred embodiment, the perforations 24 in the burner pipe 14 are disposed within the burner pipe 14 at a slight angle to the vertical so that gas flowing out of the perforations is directed towards the front of the container pan 12. Preferably, the perforations are angled towards the front of the container pan 12 between about 5 degrees and about 35 degrees from the vertical, most preferably between about 10 degrees and 20 degrees from the vertical.

In a typical embodiment, the downstream end 26 of the burner pipe 14 is capped and the upstream end 28 of the burner pipe 14 comprises connection means to attach the burner pipe 14 to a source of combustion gas (not shown). Such connection means can be a conventional threaded end.

The gas deflector plate 16 is disposed in between and transverse to the side walls 22 in a plane parallel to the burner pipe 14. The deflector plate 16 extends between the burner pipe 14 and the forward moiety of the bottom wall 18 of the container pan 12. The forward edge of the deflector plate 16 is disposed proximate to the bottom wall 18 of the container pan 12 so as to form a narrow, horizontal slit 30.

In a typical embodiment, the gas deflector plate 16 is disposed proximate to the opposing side walls 22. Preferably the gas deflector plate 16 is actually attached to the opposing side walls 22. Also, it is preferable for the gas deflector plate 16 to be physically attached to the top of the burner pipe 14.

The narrow, horizontal slit 30 has a central section 32 and two opposing periphery sections 34. The height of the central section 32 is more than about 30% greater than the height of the periphery sections 34. In a typical embodiment, the height of the central section 32 is uniform and measures between about ⅛ inch and about ⅝ inch. Typically, the periphery sections 34 are between about ¾ inches and about 3 inches in length, preferably between about 1 inch and about 1½ inches. The central section 32 is at least 80% longer than the length of either of the periphery sections 34 and, preferably, between four and ten times the length of either of the periphery sections 34.

In a preferred embodiment, a small vertical baffle 36 is disposed along the forward edge of the bottom wall 18 to form a "gas dam." The vertical baffle 36 is disposed between about ½ inch and about 2 inches forward of the horizontal slit 30. In a typical embodiment, the height of the vertical baffle 36 is also between about ½ inch and about 2 inches.

The burner unit is advantageously used by filling the container pan 12 about 40% full of large grained sand and then placing above the sand a layer of irregularly-shaped, larger noncombustible particles, such as crushed cinders.

In operation, gas from a combustion gas source (not shown) is caused to flow into the burner pipe 14, out of the burner pipe perforations 24 and into the container pan 12. The majority of the gas flows forward underneath the deflector plate 16 and exits through the horizontal slit 30. Some of the gas, however, flows towards the back of the container pan 12 and exits around the rear edge of the deflector plate 16. The gas percolates upward through the bed of non-combustion particles and is ignited across the surface of the bed.

Because of the unique configuration of the burner assembly of the invention, gas distribution tends to be very even across the top of the bed. The result is a consistent glowing fire above the top of the bed. The gas is well-aerated so that it is fully combusted, but the burner assembly operates with a minimum of gas-flow noise.

What is claimed is:

1. A gas burner assembly comprising:

(a) an open-topped container pan having a bottom wall, a back wall and two opposing side walls, the bottom wall having a forward moiety and a rearward moiety;

(b) a perforated gas burner pipe header disposed above the bottom wall and in between and transverse to the two opposing side walls;

(c) means for connecting the burner pipe to a source of combustion gas;

(d) a gas deflector plate having a forward edge and a rearward edge, the deflector plate being disposed in between and transverse to the side walls and in a plane parallel to the burner pipe;

wherein the deflector plate extends between the burner pipe and the forward moiety of the bottom wall with the forward edge of the deflector plate being disposed proximate to the bottom wall so as to form a narrow, horizontal slit having a central section and two opposing periphery sections; and wherein the height of the central section of the horizontal slit is more than 30% greater than the height of the periphery sections of the horizontal slit.

2. The gas burner assembly of claim 1 wherein the central section of the horizontal slit is uniform in height.

3. The gas burner assembly of claim 2 wherein the height of the central section of the horizontal slit is between about ⅛ inch and ⅝ inch.

4. The gas burner assembly of claim 1 wherein the central section of the horizontal slit is at least 80% longer than the length of either of the periphery sections of the horizontal slit.

5. The gas burner assembly of claim 1 wherein each of the periphery sections of the horizontal slit is between about ¾ inches and about 3 inches in length.

6. The gas burner assembly of claim 1 wherein the periphery sections of the horizontal slit are both between about 1 inch and about 1½ inches in length.

7. The gas burner assembly of claim 1 wherein the gas deflector plate is disposed proximate to the opposing sidewalls.

8. The gas burner assembly of claim 1 wherein the gas deflector plate is attached to the opposing sidewalls.

9. The gas burner assembly of claim 1 wherein the gas deflector plate is attached to the burner pipe.

10. The gas burner assembly of claim 1 wherein the opposing side walls of the container pan are triangular in shape.

11. The gas burner assembly of claim 1 wherein the opposing sidewalls of the container pan are disposed in parallel planes spaced apart by a distance between about 10 inches and about 36 inches.

12. The gas burner assembly of claim 1 wherein the opposing sidewalls of the container pan are disposed perpendicular to the bottom wall.

13. The gas burner assembly of claim 1 wherein the burner pipe is disposed horizontally between the opposing sidewalls.

14. The gas burner assembly of claim 1 wherein the perforations in the burner pipe are angled toward the forward moiety of the bottom wall at an angle between about 5° and about 35° from the vertical.

15. The gas burner assembly of claim 1 wherein the perforations in the burner pipe are angled toward the forward moiety of the bottom wall at an angle between about 10° and about 20° from the vertical.

16. The gas burner assembly of claim 1 wherein the perforations in the burner pipe are uniform in diameter.

17. The gas burner assembly of claim 1 wherein a vertical baffle is attached to the forward moiety of the bottom wall at a location forward of the horizontal slit.

18. The gas burner assembly of claim 1 wherein the height of the vertical baffle is between about ½ inch and about 2 inches.

19. The gas burner assembly of claim 1 wherein the distance between the vertical baffle and the horizontal slit is between about ½ inch and about 2 inches.

20. A gas burner assembly comprising:

(a) An open-topped container pan having a bottom wall, a back wall and opposing side walls, the bottom wall having a forward moiety and a rearward moiety, the side walls being disposed in parallel vertical planes perpendicular to the bottom wall, and the opposing side walls being triangular in shape with a height proximate to the back wall of between about 4 inches and about 10 inches;

(b) A perforated gas burner pipe disposed horizontally between about 1 inch and about 4 inches above the bottom wall and disposed in between and transverse to the two opposing side walls;

(c) Means for connecting the burner pipe to a source of combustion gas;

(d) A gas deflector plate having a forward edge, a rearward edge and opposing side edges, the rearward edge being attached to the gas burner pipe and each of the opposing side edges being attached to a corresponding opposing side wall of the container pan;

wherein the forward edge of the defector plate is disposed proximate to the bottom wall so as to form a narrow, horizontal slit having a central section and two opposing periphery sections;

wherein the central section of the horizontal slit is between about 4 and 10 times the length of either of the periphery sections; and wherein the height of the central portion of the horizontal slit is at least about 50% greater than the height of the periphery sections of the horizontal slit.

* * * * *